US012429052B2

(12) United States Patent
Nemit, Jr. et al.

(10) Patent No.: US 12,429,052 B2
(45) Date of Patent: Sep. 30, 2025

(54) VOLUME RATIO CONTROL SYSTEM FOR A COMPRESSOR

(71) Applicant: Tyco Fire & Security GmbH, Neuhausen am Rheinfall (CH)

(72) Inventors: Paul Nemit, Jr., Greencastle, PA (US); Angela Marie Comstock, Roanoke, VA (US); Franklin Aaron Montejo, York, PA (US); Colin Campbell, Auburn Hills, MI (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/732,436

(22) Filed: Jun. 3, 2024

(65) Prior Publication Data

US 2024/0318656 A1 Sep. 26, 2024

Related U.S. Application Data

(63) Continuation of application No. 17/791,183, filed as application No. PCT/US2021/012451 on Jan. 7, 2021, now Pat. No. 12,000,399.

(Continued)

(51) Int. Cl.

| | |
|---|---|
| ***F04C 18/16*** | (2006.01) |
| ***F04C 28/12*** | (2006.01) |
| ***F25B 41/39*** | (2021.01) |

(52) U.S. Cl.

CPC ..... *F04C 18/16* (2013.01); *F04C 28/12* (2013.01); *F25B 41/39* (2021.01);

(Continued)

(58) Field of Classification Search

CPC .... F04C 18/16; F04C 28/12; F25B 2339/047; F25B 2400/13; F25B 2600/0253; F25B 41/39

See application file for complete search history.

(56) References Cited

U.S. PATENT DOCUMENTS 3,432,089 A * 3/1969 Schibbye ..... F02B 53/00 417/310
3,885,402 A * 5/1975 Moody, Jr. ..... F04C 29/042 62/505

(Continued)

FOREIGN PATENT DOCUMENTS

CN 1176680 A 3/1998
CN 1240017 A 12/1999

(Continued)

OTHER PUBLICATIONS

International Search Report and Written Opinion for PCT Application No. PCT/US2021/012451, mailed Mar. 5, 2021, 12 pgs.

(Continued)

*Primary Examiner* — Jesse S Bogue
(74) *Attorney, Agent, or Firm* — Fletcher Yoder, PC

(57) ABSTRACT

A volume ratio control system for a compressor includes a chamber formed within a housing of the compressor, where the chamber is in fluid communication with a high pressure side of the compressor, a piston disposed within the chamber, where the piston includes a cavity in fluid communication with a low pressure side of the compressor, and a biasing device disposed within the chamber and configured to enable movement of the piston in response to a pressure differential between the low pressure side of the compressor and the high pressure side of the compressor falling below a threshold value.

20 Claims, 7 Drawing Sheets

Related U.S. Application Data

(60) Provisional application No. 62/958,204, filed on Jan. 7, 2020.

(52) U.S. Cl.
CPC ..... *F25B 2339/047* (2013.01); *F25B 2400/13* (2013.01); *F25B 2600/0253* (2013.01)

(56) References Cited

U.S. PATENT DOCUMENTS

| | | | | |
|---|---|---|---|---|
| 4,042,310 | A * | 8/1977 | Schibbye | F04C 28/125 417/310 |
| 4,515,540 | A | 5/1985 | Pilis | |
| 4,553,911 | A * | 11/1985 | Pillis | F04C 29/042 417/53 |
| 4,609,329 | A | 9/1986 | Pillis et al. | |
| 5,044,894 | A | 9/1991 | Field et al. | |
| 5,183,395 | A | 2/1993 | Langouet | |
| 5,240,388 | A | 8/1993 | Matsumoto et al. | |
| 5,979,168 | A * | 11/1999 | Beekman | F04C 18/16 417/310 |
| 6,739,853 | B1 | 5/2004 | Tang et al. | |
| 8,641,395 | B2 | 2/2014 | Nemit | |
| 9,970,440 | B2 * | 5/2018 | Zhu | F04C 28/125 |
| 10,794,382 | B2 | 10/2020 | Loerch et al. | |
| 2004/0109782 | A1 | 6/2004 | Tang et al. | |
| 2014/0026414 | A1 | 1/2014 | Holmes et al. | |
| 2014/0260414 | A1 * | 9/2014 | Nemit, Jr. | F25B 1/047 62/498 |
| 2018/0356128 | A1 | 12/2018 | Johnson et al. | |
| 2020/0291942 | A1 * | 9/2020 | Yang | F04C 18/088 |

FOREIGN PATENT DOCUMENTS

| | | | |
|---|---|---|---|
| CN | 1745251 | A | 3/2006 |
| CN | 102042226 | A | 5/2011 |
| CN | 204267294 | U | 4/2015 |
| CN | 105579709 | A | 5/2016 |
| CN | 105715548 | A | 6/2016 |
| CN | 106122016 | A | 11/2016 |
| CN | 108661906 | A | 10/2018 |
| CN | 109458340 | A | 3/2019 |
| CN | 109715951 | A | 5/2019 |
| DE | 69103827 | T2 | 1/1995 |
| GB | 1335024 | A * | 10/1973 |
| GB | 2295661 | B | 12/1998 |
| JP | H05187378 | A | 7/1993 |
| JP | H11148480 | A | 6/1999 |
| JP | 2008075618 | A | 4/2008 |

OTHER PUBLICATIONS

Chinese Office Action for CN Application No. 202180012210.0, dated Mar. 12, 2024, 10 pages.
Chinese Office Action for CN Application No. 202180012173.3, dated Mar. 12, 2024, 9 pages.
Chinese Office Action for CN Application No. 202180012210.0, dated Aug. 13, 2024, 3 pages.
Chinese Office Action for CN Application No. 202180012173.3, dated Aug. 22, 2024, 3 pages.

* cited by examiner

VOLUME RATIO CONTROL SYSTEM FOR A COMPRESSOR

CROSS REFERENCE TO RELATED APPLICATION

This is a continuation of U.S. patent application Ser. No. 17/791,183, entitled "VOLUME RATIO CONTROL SYSTEM FOR A COMPRESSOR," filed Jul. 6, 2022, which is a U.S. National Stage Application of PCT International Application No. PCT/US2021/012451, entitled "VOLUME RATIO CONTROL SYSTEM FOR A COMPRESSOR," filed Jan. 7, 2021, which claims priority to and the benefit of U.S. Provisional Application No. 62/958,204, entitled "VOLUME RATIO CONTROL SYSTEM FOR A COMPRESSOR," filed Jan. 7, 2020, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC&R systems are used in a variety of settings and for many purposes. For example, HVAC&R systems may include a vapor compression refrigeration cycle (e.g., a refrigerant circuit having a condenser, an evaporator, a compressor, and/or an expansion device) configured to condition an environment. The vapor compression refrigeration cycle may include a compressor that is configured to direct refrigerant through various components of the refrigerant circuit. In some cases, a pressure of refrigerant at various positions along the refrigerant circuit may fluctuate during operation of the vapor compression refrigeration cycle. Accordingly, a compression ratio (e.g., a ratio between a low or suction pressure and a high or discharge pressure) of the compressor may be adjusted to maintain operating parameters of the vapor compression refrigeration cycle at target levels. To adjust the compression ratio of the compressor, a speed of one or more rotors of the compressor may be adjusted via a motor or another suitable drive. Additionally, a volume ratio of the compressor may be adjusted based on the compression ratio to maintain a performance of the compressor.

Existing compressors may be configured to adjust the volume ratio in response to a given compression ratio via stepwise control of a piston between one or more positions. Additionally or alternatively, a proportional valve may be utilized to supply a fluid into a piston chamber to adjust the position of the piston. Unfortunately, existing techniques for controlling the volume ratio of the compressor may be limited based on the finite number of positions of the piston and/or may increase costs by including additional components, such as the proportional valve and corresponding control devices.

SUMMARY

In an embodiment of the present disclosure, a volume ratio control system for a compressor includes a chamber formed within a housing of the compressor, where the chamber is in fluid communication with a high pressure side of the compressor, a piston disposed within the chamber, where the piston includes a cavity in fluid communication with a low pressure side of the compressor, and a biasing device disposed within the chamber and configured to enable movement of the piston in response to a pressure differential between the low pressure side of the compressor and the high pressure side of the compressor falling below a threshold value.

In another embodiment of the present disclosure, a heating, ventilation, air conditioning, and/or refrigeration (HVAC&R) system includes a compressor configured to circulate a refrigerant through a refrigerant circuit and a volume ratio control system configured to adjust a volume ratio of the compressor. The volume ratio control system includes a chamber formed in a housing of the compressor and in fluid communication with a high pressure side of the compressor, a piston disposed within the chamber, where the piston includes a cavity in fluid communication with a low pressure side of the compressor, and a biasing device disposed within the cavity, where the biasing device is configured to enable movement of the piston in response to a pressure differential between the low pressure side of the compressor and the high pressure side of the compressor falling below a threshold value.

In a further embodiment of the present disclosure, a volume ratio control system for a compressor includes a chamber formed within a housing of the compressor, where the chamber includes a first portion in fluid communication with a high pressure side of the compressor and a second portion in fluid communication with a low pressure side of the compressor and a rod extending through an opening of the housing separating the first portion and the second portion of the chamber, where the rod is fixed within the chamber with respect to an axis defining a length of the chamber. The volume ratio control system also includes a piston disposed within the first portion of the chamber, where the piston includes a cavity in fluid communication with the second portion of the chamber, and where the rod is configured to be at least partially disposed within the cavity of the piston, and a biasing device disposed within the cavity between the rod and an interior surface of the piston, where the biasing device is configured to enable movement of the piston in response to a pressure differential between the low pressure side of the compressor and the high pressure side of the compressor falling below a threshold value.

DETAILED DESCRIPTION

Figure 1:
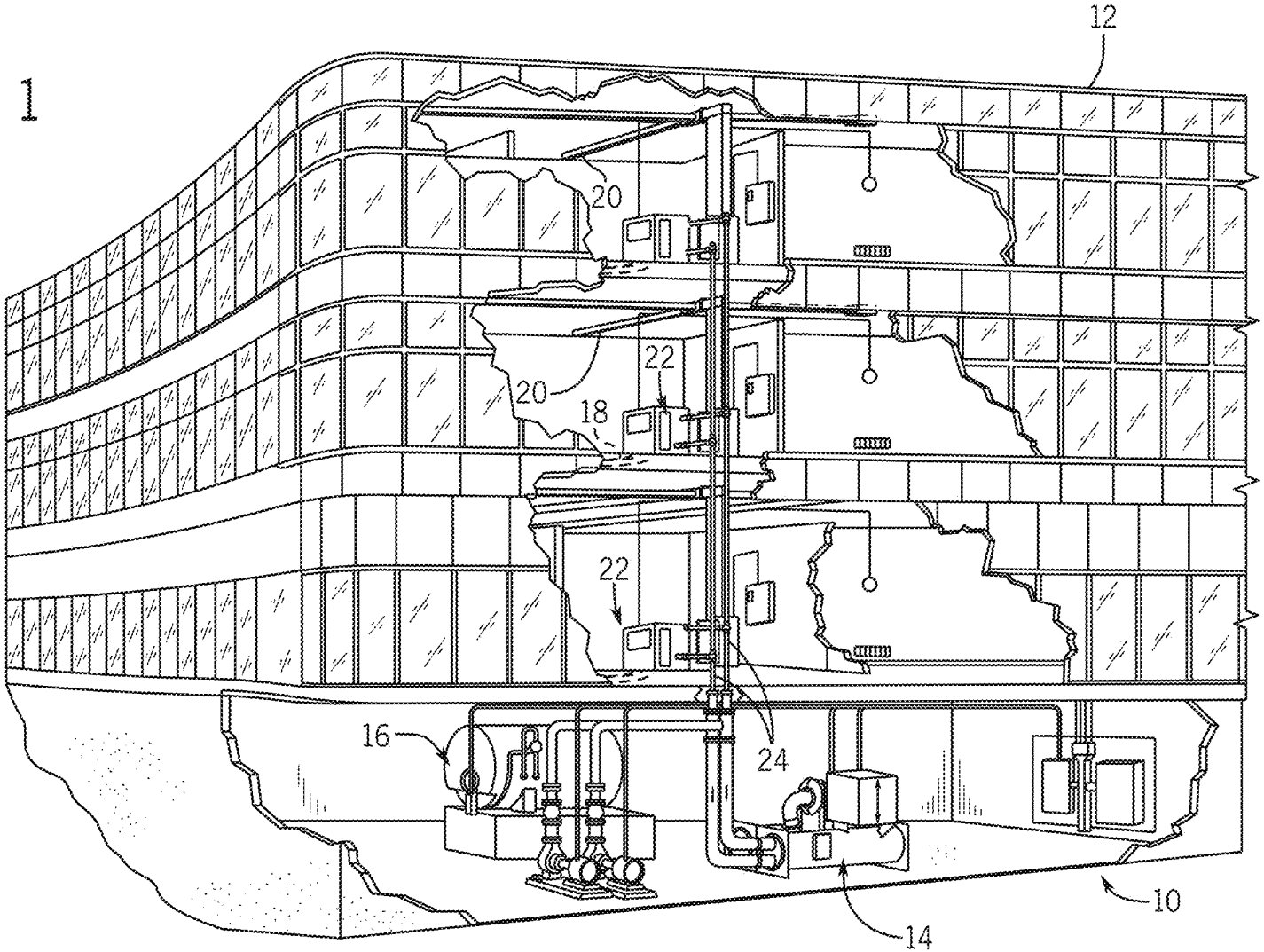
FIG. 1 is a perspective view of a building that may utilize an embodiment of a heating, ventilation, air conditioning, and/or refrigeration (HVAC&R) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, a vapor compression refrigeration cycle may include a compressor that is configured to circulate a refrigerant through a refrigerant circuit of the vapor compression refrigeration cycle. In some cases, various operating parameters of the refrigerant may fluctuate during operation of the vapor compression refrigeration cycle. A compression ratio of the compressor may be adjusted in order to maintain and/or adjust operating parameters of the refrigerant within the refrigerant circuit toward target levels. The compression ratio of the compressor may be controlled via a motor that supplies torque to one or more rotors of the compressor. Therefore, an operating speed of the motor is adjusted in order to control the compression ratio to be a target value. Further, a volume ratio of the compressor may be adjusted based on the compression ratio in order to maintain a performance (e.g., an efficiency) of the compressor during operation. Indeed, in some cases, an amount of refrigerant drawn into the compressor may exceed an amount that achieves the target compression ratio. Accordingly, the volume ratio may be adjusted by enabling refrigerant to bypass a compression portion of the compressor in order to reduce the volume ratio. Similarly, an amount of refrigerant drawn into the compressor may be less than an amount that achieves the target compression ratio. In such instances, the volume ratio may be adjusted by blocking refrigerant from bypassing the compression portion in order to increase the volume ratio of the compressor.

Existing compressors may control the volume ratio of the compressor using a piston that may be adjusted to a finite number of positions. For example, the piston may be in fluid communication with a high pressure side of the compressor to enable the refrigerant to bypass the compression portion of the compressor based on the position of the piston. Further, some existing compressors may include a proportional valve that directs a working fluid toward a piston chamber to generate movement of the piston, thereby providing control over the position of the piston. However, such existing systems may be limited in controlling the volume ratio and/or may increase costs of the vapor compression refrigeration cycle.

As such, embodiments of the present disclosure are directed to an improved volume ratio control system that may enhance control of the volume ratio of the compressor without including relatively expensive components. For instance, the volume ratio control system of the present disclosure may include a biasing device, such as a spring, to control a position of a piston disposed within a chamber of the compressor. The chamber and/or the piston may be in fluid communication with both a low pressure portion (e.g., suction side) of the compressor and a high pressure portion (e.g., discharge side) of the compressor, such that a pressure differential is generated within the chamber and/or across the piston. Under some operating conditions, the pressure differential within the chamber and/or across the piston may exceed a threshold, thereby causing the piston to move in a first direction to adjust the volume ratio of the compressor (e.g., increase the volume ratio of the compressor in response to an increase in compression ratio). When the pressure differential falls below the threshold, the biasing device may cause the piston to move in a second direction, opposite the first direction, to adjust the volume ratio of the compressor (e.g., decrease the volume ratio of the compressor in response to a reduction in compression ratio). The piston may be configured to move in the second direction to expose openings that enable refrigerant to bypass a compression portion (e.g., at least a portion of a compression chamber) of the compressor, such that the volume ratio is reduced when the piston exposes or does not cover the openings. Similarly, the volume ratio of the compressor may be increased when the piston moves in the first direction to cover and/or block the openings, thereby reducing the amount of refrigerant that bypasses the compression portion. The volume ratio control system of the present disclosure is thus a passive system that utilizes the pressure differential within the chamber and a biasing force applied to the piston by the biasing device in order to adjust the volume ratio of the compressor. Indeed, the volume ratio control system may be infinitely variable, such that the piston may move toward virtually any position within the chamber and is not limited to predetermined or discrete positions.

Turning now to the drawings, FIG. 1 is a perspective view of an embodiment of an environment for a heating, ventilation, air conditioning, and/or refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
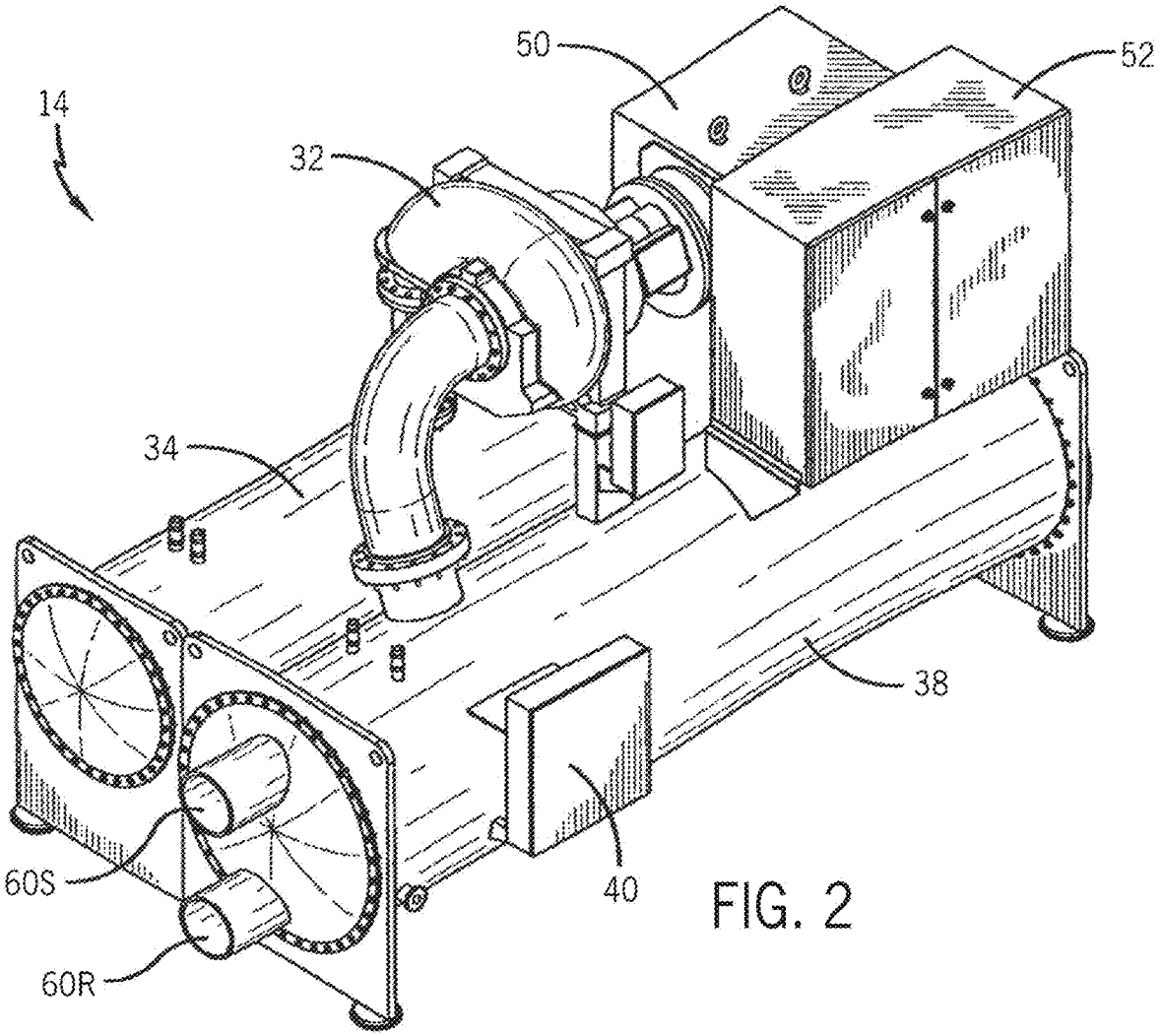
FIG. 2 is a perspective view of an embodiment of a vapor compression system, in accordance with an aspect of the present disclosure.
Figure 3:
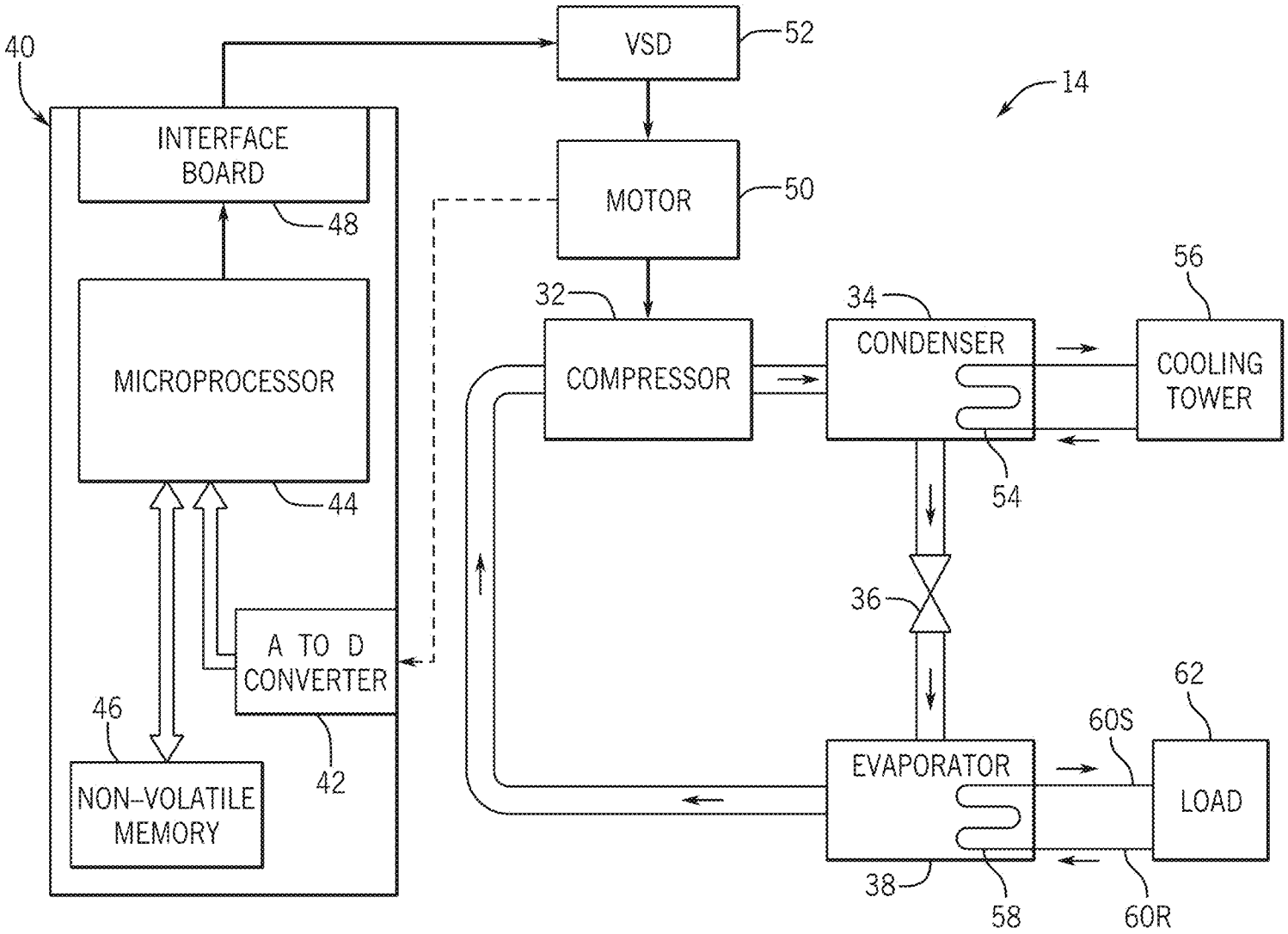
FIG. 3 is a schematic diagram of an embodiment of a vapor compression system, in accordance with an aspect of the present disclosure.

FIGS. 2 and 3 illustrate embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., a controller) that has an analog to digital (A/D) converter 42, a microprocessor 44, a non-volatile memory 46, and/or an interface board 48.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a screw compressor. The compressor 32 includes a fluid (e.g., oil) that lubricates components of the compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
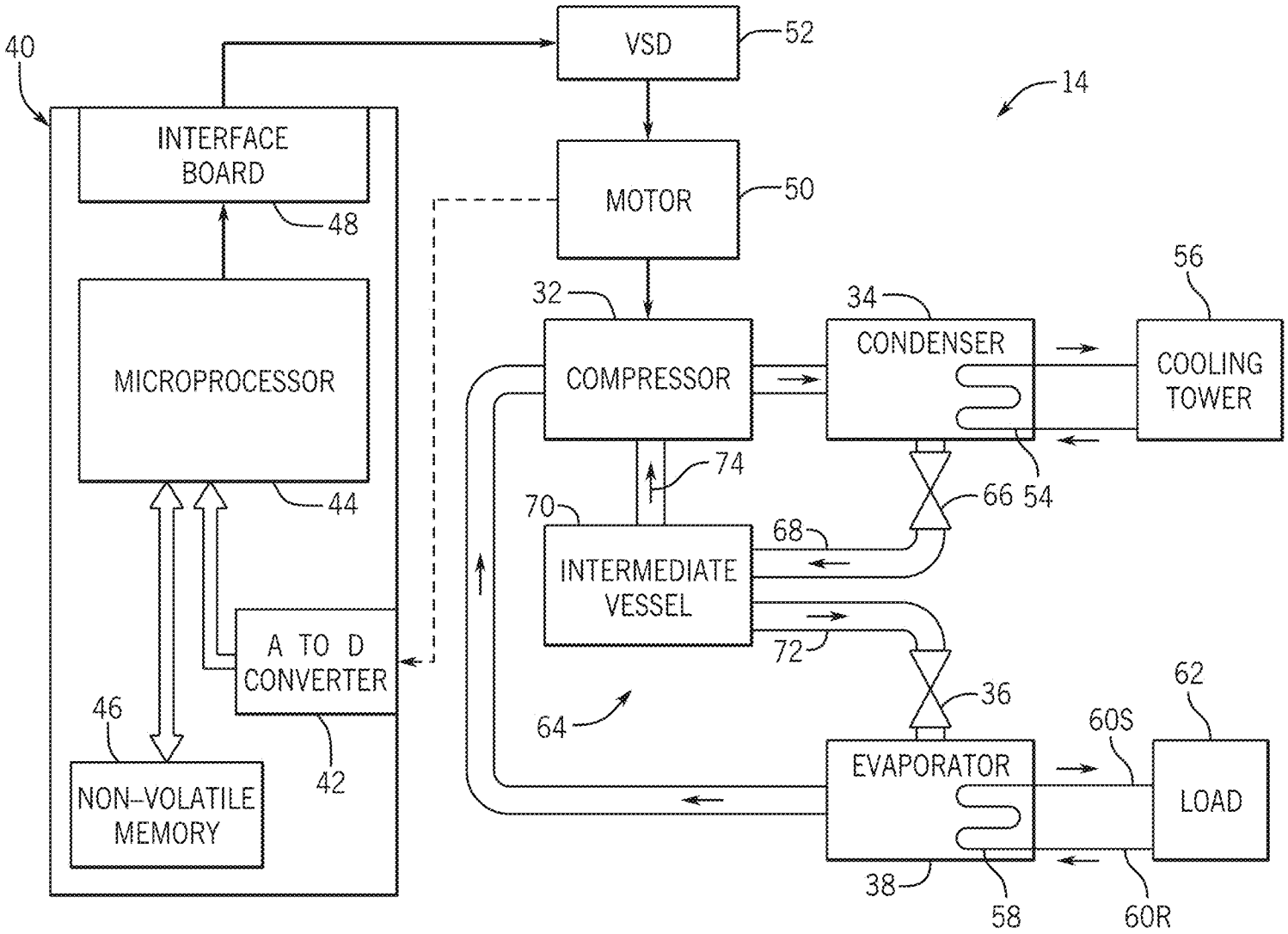
FIG. 4 is a schematic diagram of another embodiment of a vapor compression system, in accordance with an aspect of the present disclosure.

FIG. 4 is a schematic diagram of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

As discussed above, embodiments of the present disclosure are directed to an improved volume ratio control system for a compressor, such as the compressor 32. The volume ratio control system may include a piston and a rod (e.g., a stationary rod) disposed within a chamber of the compressor. The piston may be disposed within at least a portion of the chamber that is exposed to a high pressure side of the compressor. For example, the high pressure side may be a discharge side of the compressor, such that an exterior surface of the piston is also exposed to the discharge side of the compressor (e.g., a discharge pressure of the compressor). In some embodiments, the exterior surface of the piston may be additionally or alternatively be exposed to an oil pressure of the compressor. Further, a cavity of the piston may be in fluid communication with a low pressure side of the compressor. For example, the low pressure side may be a suction side of the compressor (e.g., a suction pressure of the compressor), thereby exposing an interior surface of the piston to the suction side of the compressor. As such, a pressure differential force may be applied to the piston as opposing pressure forces applied to the exterior surface and the interior surface of the piston vary. The pressure differential force may at least partially control a position of the piston with respect to the chamber and/or the rod. Additionally, a biasing device, such as a spring, may be disposed in the cavity between the piston and the rod. The biasing device may direct movement of the piston (e.g., with respect to the rod) when the pressure differential force falls below a threshold value. As used herein, the threshold value of the pressure differential force may be a function of a biasing force of the biasing device and/or a position of the piston within the chamber (and/or with respect to the rod). Indeed, the threshold value of the pressure differential force may change based at least on a current length and/or a current level of extension of the biasing device. For instance, the biasing force exerted by the biasing device may change as the biasing device extends and/or contracts from a natural or unbiased position (e.g., the biasing force increases as the biasing device moves further from the natural or unbiased position).

In any case, the volume ratio control system of the present disclosure is passive in that the volume ratio control system adjusts the volume ratio of the compressor as a result of the pressure differential established between the chamber and the cavity of the piston, which may be indicative of the compression ratio of the compressor. In other words, additional mechanical components, such as valves, motors, and/or other devices, may not be included to adjust the volume ratio of the compressor. Further, the volume ratio control system is generally infinitely variable because a position of the piston within the chamber is not limited to stepwise or predetermined positions. Therefore, the volume ratio control system enables accurate and/or precise volume ratio control of the compressor without including relatively expensive components that add costs to the vapor compression system 14.

Figure 5:
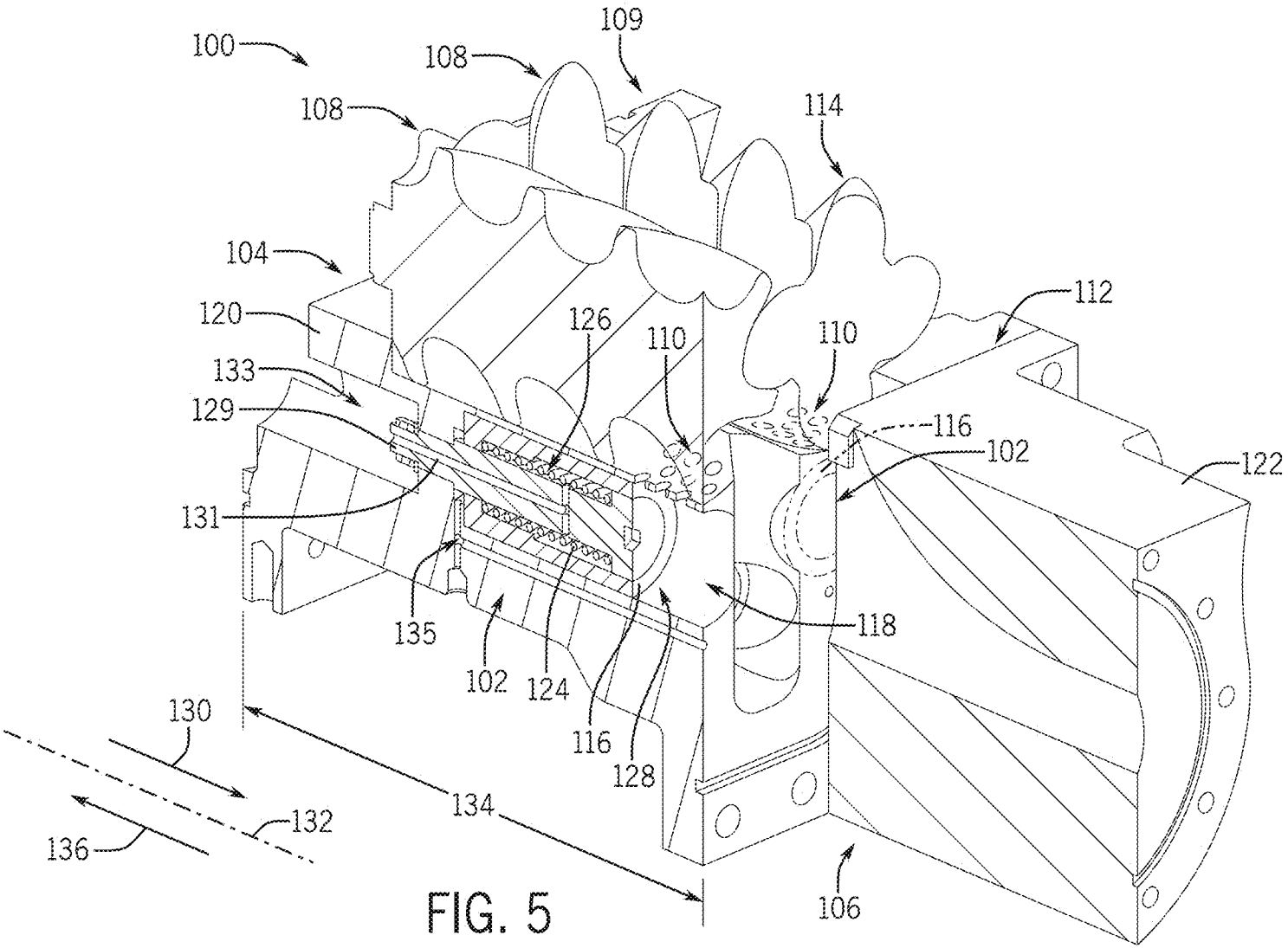
FIG. 5 is a cutaway perspective view of an embodiment of a compressor having a volume ratio control system that may be included in a vapor compression system, in accordance with an aspect of the present disclosure.

For example, FIG. 5 is a cutaway perspective view of an embodiment of a compressor 100, such as the compressor 32, having a volume ratio control system 102. As shown in the illustrated embodiment of FIG. 5, the compressor 100 includes two volume ratio control systems 102. In other embodiments, the compressor 100 may include a single volume ratio control system 102 or more than two volume ratio control systems 102 depending on a size and/or capacity of the compressor 100. In any case, the compressor 100 may include a low pressure side 104 (e.g., suction side, suction portion) that draws refrigerant from a component disposed along a refrigerant circuit of the vapor compression system 14 (e.g., from the evaporator 38) and a high pressure side 106 (e.g., a discharge side, discharge portion, oil pressure) that directs high-pressure refrigerant toward a component disposed along the refrigerant circuit (e.g., toward the condenser 34). The compressor 100 includes rotors 108 that are configured to rotate and compress the refrigerant received on the low pressure side 104, thereby increasing the pressure of the refrigerant exiting the compressor 100 via a discharge port positioned on the high pressure side 106. For instance, the rotors 108 may be driven to rotate via a motor. As the rotors 108 rotate, threads of the rotors 108 may reduce a volume of the refrigerant within a compression chamber 109 of the compressor 100, which in turn, increases the pressure of the refrigerant.

As shown in the illustrated embodiment of FIG. 5, the compressor 100 includes openings 110 within a housing 112 of the compressor 100 that enable refrigerant to bypass at least a portion 114 of the compression chamber 109 and direct the refrigerant toward the high pressure side 106. In other words, refrigerant flowing through the openings 110 may reduce an amount of refrigerant that is ultimately compressed by the rotors 108, thereby reducing a volume ratio of the compressor 100. In some embodiments, the openings 110 may be formed in a portion of the housing 112 associated with and/or containing one of the rotors 108. For example, a first set of openings 110 may be formed in a portion of the housing 112 associated with and/or containing one of the rotors 108 (e.g., a male rotor), and a second set of openings 110 may be formed in a portion of the housing 112 associated with and/or containing another of the rotors 108 (e.g., a female rotor). As mentioned above, the illustrated compressor 100 includes two volume ratio control systems 102. Each volume ratio control system 102 may be associated with one of the sets of openings 110 and may operate to occlude and/or expose the respective set of openings 110 in the manner described below. However, in other embodiments, the compressor 100 may include one volume ratio control system 102 associated with both sets of openings 110, such that the single volume ratio control system 102 operates to occlude and/or expose the openings 110 associated with both rotors 108 (e.g., a male rotor and a female rotor).

The volume ratio control system 102 is configured to adjust an amount of the refrigerant within the compressor 100 that flows through the openings 110 and bypasses at least the portion 114 of the compression chamber 109. For example, the volume ratio control system 102 includes a piston 116 (e.g., an annular piston) disposed within a chamber 118 formed into the housing 112. The chamber 118 may be in fluid communication with the openings 110 and may extend into a first portion 120 of the housing 112 that is proximate to the low pressure side 104. Additionally, the chamber 118 may extend into a second portion 122 of the housing 112 that is proximate to the high pressure side 106. In any case, the piston 116 is configured to move within the chamber 118 to block and/or expose the openings 110 to control the amount of refrigerant bypassing the portion 114 of the compression chamber 109.

As is described in further detail herein, movement of the piston 116 within the chamber 118 may be passively controlled by a biasing device 124 (e.g., a spring) and/or a pressure differential between a cavity 126 formed within the piston 116 (e.g., fluidly coupled to the low pressure side 104 of the compressor 100, such as via ports, conduits, etc.) and at least a portion 128 of the chamber 118 (e.g., fluidly coupled to the high pressure side 106 of the compressor 100, such as via a discharge line 135). In some embodiments, the volume ratio control system 102 includes a rod 129 (e.g., a stationary rod) disposed within the chamber 118 and within the cavity 126 of the piston 116. As shown in the illustrated embodiment of FIG. 5, the biasing device 124 may be disposed between the rod 129 and the piston 116 within the cavity 126. Additionally, the rod 129 may include a passage 131 that fluidly couples an additional portion 133 of the chamber 118 (e.g., fluidly coupled to the low pressure side 104 of the compressor 100) and the cavity 126. Accordingly, in some embodiments, the pressure within the cavity 126 of the piston 129 may be substantially equal to (e.g., within 10% of, within 5% of, or within 1% of) a low or suction pressure of the compressor 100.

In any case, the biasing device 124 and the pressure differential between the cavity 126 and the portion 128 of the chamber 118 may enable movement of the piston 116 within the chamber 118 and/or with respect to the rod 129. For instance, the cavity 126 may include a relatively low pressure associated with refrigerant entering the compressor 100 on the low pressure side 104, whereas the portion 128 of the chamber 118 may include a relatively high pressure associated with refrigerant exiting the compressor 100 on the high pressure side 106. The pressure differential between the cavity 126 and the portion 128 of the chamber 118 may direct movement of the piston 116 within the chamber 118 upon reaching and/or exceeding a threshold pressure differential (e.g., a variable pressure differential threshold). For example, when the pressure differential is at and/or exceeds the threshold pressure differential, a force is exerted on the piston 116 to direct movement of the piston 116 in a first direction 130 along an axis 132 defining a length 134 (see, e.g., FIG. 6) of the chamber 118. As the piston 116 moves in the first direction 130, the piston 116 may block and/or cover one or more of the openings 110 to the chamber 118 (e.g., block refrigerant from bypassing the portion 114 of the rotors 108 and/or compression chamber 109). Accordingly, as the compression ratio of the compressor 100 increases, the volume ratio is increased by the volume ratio control system 102 to maintain a performance (e.g., efficiency) of the compressor 100.

Further, the biasing device 124 exerts a force on the piston 116 that may direct movement of the piston 116 in a second direction 136, opposite the first direction 130, along the axis 132 when the pressure differential between the cavity 126 and the portion 128 falls below the pressure differential threshold (e.g., a variable pressure differential threshold). For example, the biasing device 124 may include target parameters that apply a target biasing force on the piston 116 at various positions within the chamber 118 to enable movement of the piston 116 in the second direction 136 when the pressure differential between the cavity 126 and the portion 128 falls below the pressure differential threshold for the given position of the piston 116 within the chamber 118. Parameters of the biasing device 124 that may be selected or modified to achieve a desired biasing force or range of biasing forces may include a material (e.g., metal, polymer) of the biasing device 124, a coil diameter of the biasing device 124, an internal diameter of the biasing device 124, an external diameter of the biasing device 124, a coil pitch of the biasing device 124, a number of coils of the biasing device 124, a spring rate of the biasing device 124, a free length of the biasing device 124, a block length of the biasing device 124, another suitable parameter of the biasing device 124, or any combination thereof. In any case, the pressure differential between the cavity 126 and the portion 128 and the target biasing force of the biasing device 124 may passively direct movement of the piston 116 within the chamber 118 to adjust the volume ratio of the compressor 100.

Figure 6:
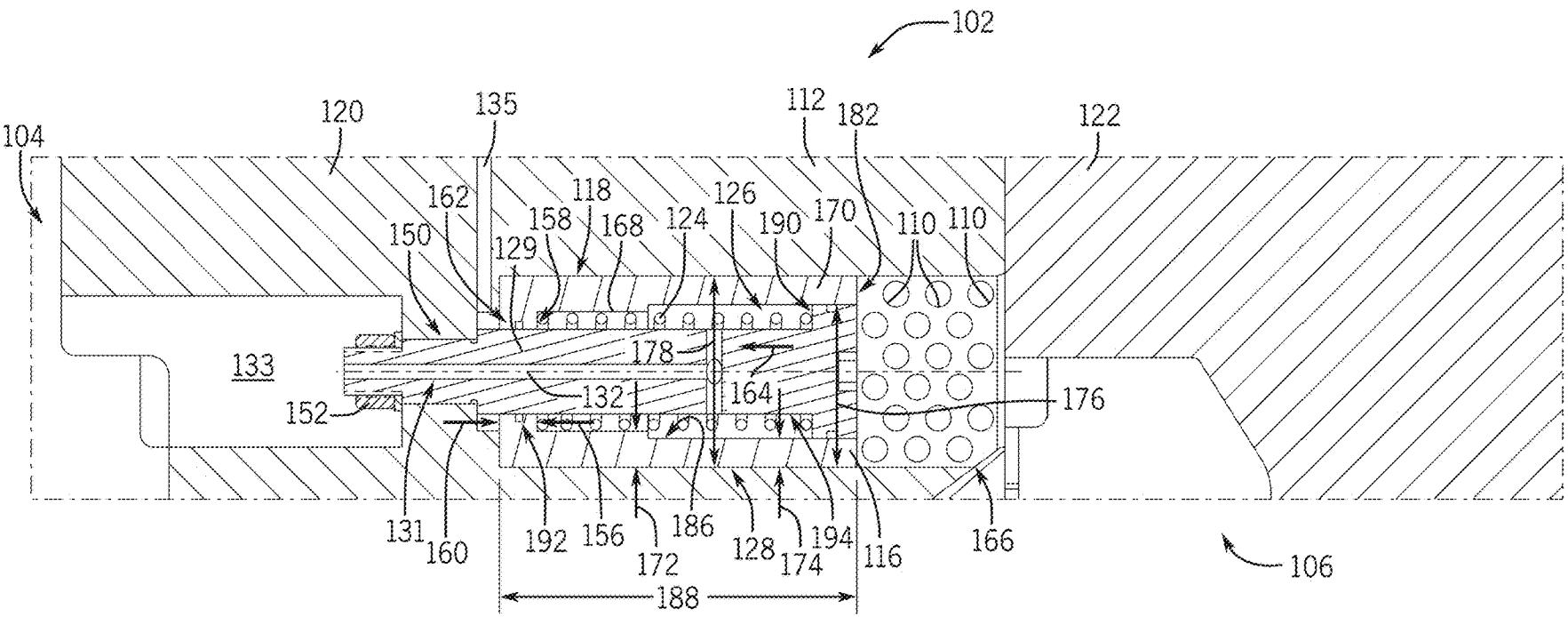
FIG. 6 is a cross-sectional schematic diagram of an embodiment of a volume ratio control system for the compressor in a first position, in accordance with an aspect of the present disclosure.

FIG. 6 is a schematic diagram of a cross-section of a portion of the compressor 100, illustrating the chamber 118 of the volume ratio control system 102. As shown in the illustrated embodiment of FIG. 6, the piston 116 is disposed within the portion 128 of the chamber 118. Additionally, the rod 129 extends between the additional portion 133 of the chamber 118 and the portion 128 of the chamber 118 via an opening 150 (e.g., an opening formed in the housing 112 between the portion 128 and the additional portion 133 of the chamber 118). The rod 129 may be secured within the opening 150 via a fastener 152 (e.g., a threaded fastener), which may block movement of the rod 129 with respect to and/or within the chamber 118. However, in other embodiments, the rod 129 may be secured within the opening 150 and/or relative to the chamber 118 via other mechanisms or features. For example, the rod 129 and the opening 150 may each include threads configured to engage with one another to secure the rod 129 within the opening 150.

Further, the rod 129 may form a seal between the additional portion 133 of the chamber 118 and the portion 128 of the chamber 118 to maintain a pressure differential that is substantially equal to a pressure differential between the low pressure side 104 and the high pressure side 106 of the compressor 100. In some embodiments, the rod 129 includes the passage 131 that enables fluid communication between the additional portion 133 of the chamber 118 and the cavity 126. Accordingly, a pressure within the cavity 126 may be substantially equal to the suction pressure of the compressor 100 (e.g., the additional portion 133 of the cavity 126 is exposed to the low pressure side 104 of the compressor 100). Additionally, the portion 128 of the chamber 118 may be fluidly coupled to the high pressure side 106 of the compressor 100 via the discharge line 135 and/or fluidly coupled to the openings 110.

Thus, a first pressure force (e.g., represented by arrow 156) may be applied to an interior surface 158 of the piston 116, where the first pressure force is indicative of the low (e.g., suction) pressure of the compressor 100. A second pressure force (e.g., represented by arrow 160) may be applied to an exterior surface 162 of the piston 116, where the second pressure force is indicative of the high (e.g., discharge, oil) pressure of the compressor 100. The first (e.g., low) pressure force is less than the second (e.g., high) pressure force, such that a pressure differential force (e.g., a difference between the first pressure force and the second pressure force) may be applied to the piston 116 in the first direction 130. Moreover, a biasing force (e.g., represented by arrow 164) may be applied to the piston 116 by the biasing device 124 in the second direction 136 opposite the first direction 130. Accordingly, when the pressure differential force exceeds the biasing force, the piston 116 moves in the first direction 130 toward an end 166 of the portion 128 of the chamber 118 that is proximate to the openings 110. The piston 116 may cover and/or block one or more of the openings 110, such that the volume ratio of the compressor 100 increases. Similarly, when the pressure differential force is less than the biasing force, the biasing device 124 enables the piston 116 to move in the second direction 136 away from the end 166 of the portion 128 of the chamber 118 proximate to the openings 110. Thus, one or more of the openings 110 may be exposed or uncovered, such that refrigerant may bypass the portion 114 of the compression chamber 109 and reduce the volume ratio of the compressor 100.

As shown in the illustrated embodiment, the piston 116 includes a first segment 168 and a second segment 170 that are each configured to move (e.g., jointly) in the first direction 130 and the second direction 136 within the portion 128 of the chamber 118. For example, the first segment 168 and the second segment 170 may be a single piece that forms the piston 116. The first segment 168 may include a first radial thickness 172 that is greater than a second radial thickness 174 of the second segment 170. In some embodiments, an overall diameter 176 of the piston 116 corresponds to a diameter 178 of the portion 128 of the chamber 118. For instance, the overall diameter 176 may be slightly less than the diameter 178 to enable the piston 116 to move along the axis 132 within the portion 128 of the chamber 118.

As shown in the illustrated embodiment of FIG. 6, the exterior surface 162 of the first segment 168 of the piston 116 is exposed to an interior of the portion 128 of the chamber 118, and thus, refrigerant within the portion 128 of the chamber 118. In some embodiments, the exterior surface 162 of the first segment 168 of the piston 116 may be exposed to an oil pressure of the compressor 100. As set forth above, the refrigerant in the portion 128 may include a pressure that is substantially equal to the discharge pressure of refrigerant exiting the compressor 100 (and/or an oil pressure of the compressor 100). Additionally, the second segment 170 of the piston 116 may include a second surface 182 that is also exposed to the interior of the portion 128 of the chamber 118 and, thus, the refrigerant within the portion 128 of the chamber 118 (and/or an oil pressure of the compressor 100). As such, the exterior surface 162 and the second surface 182 may be exposed to refrigerant at substantially the same pressure. As is shown in FIG. 6, a surface area of the exterior surface 162 is greater than a surface area of the second surface 182, such that an increase in discharge (or oil) pressure may cause movement in the first direction 130 via a pressure force applied to the exterior surface 162.

Further still, the interior surface 158 of the first segment 168 of the piston 118 is exposed to refrigerant that includes a pressure substantially equal to the suction pressure of refrigerant entering the compressor 100. Accordingly, as the pressure differential between the cavity 126 and the portion 128 of the chamber 118 increases, the piston 116 is directed in the first direction 130 via the pressure differential force.

In some embodiments, the biasing device 124 (e.g., a spring) may be disposed within the cavity 126 of the piston 116 between the rod 129 and an internal surface 186 of the piston 116. The rod 129 may be substantially stationary within the chamber 118, such that the piston 116 is configured to move along at least a portion of a length 188 of the rod 129. For example, the rod 129 may be coupled to the opening 150 of the chamber 118 separating the portion 128 and the additional portion 133. In some embodiments, the rod 129 may be coupled to the opening 150 via threads, as mentioned above, via bolts or other fasteners, via a weld, or via another suitable coupling technique that enables the rod 129 to maintain a position with respect to the chamber 118. Further, the biasing device 124 may be coupled to an end 190 of the rod 129, such as welded to the end 190, fastened to the end 190 via fasteners (e.g., screws, bolts, or other suitable fasteners), or coupled to the end 190 via another suitable technique. In any case, the biasing device 124 exerts a force on an end 192 of the piston 116 (e.g., such as the interior surface 158) in the second direction 136 or toward a natural position (e.g., unbiased position) of the biasing device 124. As the piston 116 is directed in the first direction 130, the biasing device 124 may compress against the end 188 of the rod 129 and exert a greater force on the piston 116. In some embodiments, the rod 129 may also act as a guide for the biasing device 124 as it compresses and decompresses due to variations in the pressure differential. For example, the biasing device 124 may be configured to move along an outer surface 194 of the rod 129 as the piston 116 moves within the portion 128 of the chamber 118. In any case, the pressure differential threshold that drives movement of the piston 116 may vary based on an amount of compression of the biasing device 124 and/or a current length of the biasing device 124 compared to a natural or unbiased length of the biasing device 124.

Figure 7:
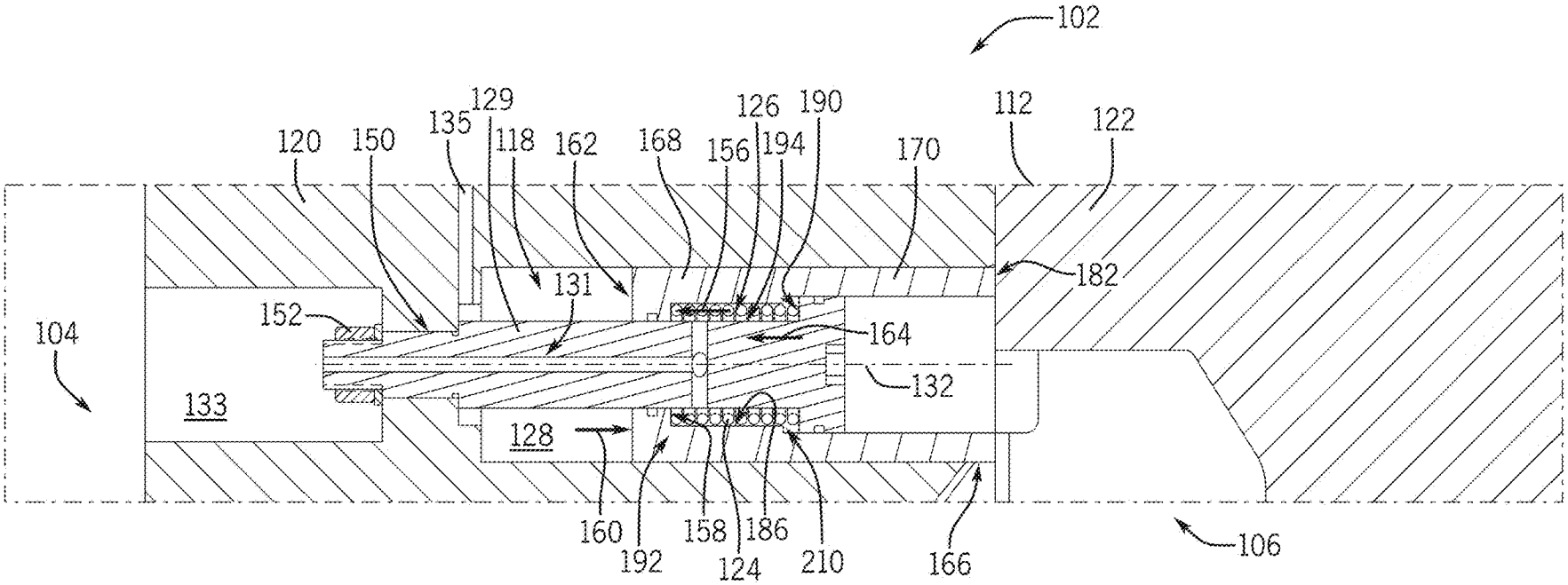
FIG. 7 is a cross-sectional schematic diagram of an embodiment of the volume ratio control system for the compressor in a second position, in accordance with an aspect of the present disclosure.

As the pressure differential between the cavity 126 and the portion 128 of the chamber 118 decreases, the biasing device 124 may direct the piston 116 to move in the second direction 136 by applying a force on the piston 116 in the second direction 136. For example, FIG. 6 illustrates the piston 116 in a substantially open position (e.g., when a volume ratio of the compressor 100 is reduced), and FIG. 7 illustrates the piston 116 in a substantially closed position (e.g., when a volume ratio of the compressor 100 is increased). As shown in the illustrated embodiment of FIG. 7, the biasing device 124 is in a compressed position 210 and exerts a force on the piston 116 in the second direction 136.

As discussed above, an amount of force exerted on the piston 116 by the biasing device 124 may be based on a position of the piston 116 within the portion 128 of the chamber 118 relative to the axis 132, an amount of extension and/or compression of the biasing device 124, parameters of the basing device 124 itself, other suitable parameters, or any combination thereof. For instance, parameters of the biasing device 124 that may contribute to the magnitude of the biasing force applied to the piston 116 may include a material (e.g., metal, polymer) of the biasing device 124, a coil diameter of the biasing device 124, an internal diameter of the biasing device 124, an external diameter of the biasing device 124, a coil pitch of the biasing device 124, a number of coils of the biasing device 124, a spring rate of the biasing device 124, a free length of the biasing device 124, a block length of the biasing device 124, another suitable parameter of the biasing device 124, or any combination thereof.

In any case, both the pressure differential within the cavity 126 of the piston 116 and the portion 128 of the chamber 118 applying a force on the exterior surface 162 of the piston 116 in the first direction 130 and the biasing force applied to the piston 116 by the biasing device 124 in the second direction 136 control movement and the position of the piston 116 within the chamber 118. The pressure differential threshold for directing movement of the piston 116 in the first direction 130 may vary based on the position of the piston 116 and/or the level of extension and/or compression of the biasing device 124. As such, the piston 116 may be positioned (e.g., stationary) at virtually any location within the portion 128 of the chamber 118 relative to the axis 132 when the opposing forces applied by the pressure differential and the biasing device 124 are substantially equal. Thus, the volume ratio control system 102 of the present disclosure may enable infinitely or substantially infinitely variable control of the volume ratio of the compressor 100.

As set forth above, embodiments of the present disclosure may provide one or more technical effects useful in controlling a volume ratio of a compressor. For example, embodiments of the present disclosure are directed to an improved volume ratio control system that may operate passively and enable infinitely variable control of the volume ratio. The volume ratio control system may include a piston disposed within at least a portion of a chamber of the compressor that is fluidly coupled to a high pressure side (e.g., discharge side or oil pressure) of the compressor. The piston may include a cavity that is fluidly coupled to a low pressure side (e.g., suction side) of the compressor. Further, a rod and a biasing device may be disposed within the cavity of the piston. As the compressor operates, a pressure differential may be established between the cavity of the piston and the chamber. When the pressure differential exceeds a threshold, the pressure differential may exert a force on the piston in a first direction causing the piston to block or cover openings that enable refrigerant to bypass at least a portion of a compression chamber of the compressor. As such, a volume ratio of the compressor is increased. When the pressure differential falls below the threshold, the biasing device may apply a force to the piston in a second direction, opposite the first direction, to unblock or expose the openings. As such, the pressure ratio of the compressor is reduced. In any case, the volume ratio control system enables passive control of the volume ratio of the compressor, which reduces costs and also enhances control over the volume ratio of the compressor. The technical effects and technical problems in the specification are examples and are not limiting. It should be noted that the embodiments described in the specification may have other technical effects and can solve other technical problems.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A volume ratio control system for a compressor, comprising:

a housing of the compressor, wherein the housing comprises a chamber formed therein, and a portion of the chamber is in fluid communication with a discharge side of the compressor; and a piston disposed within the chamber, wherein the piston comprises a cavity in fluid communication with a suction side of the compressor, an active volume of the cavity is variable, the portion of the chamber and the cavity are fluidly separate from one another, and the volume ratio control system is configured to passively adjust a position of the piston within the chamber based on a pressure differential between the portion of the chamber and the cavity of the piston.

2. The volume ratio control system of claim 1, wherein the housing comprises a plurality of openings formed therein, the plurality of openings is fluidly coupled to the chamber at an end of the chamber, and the plurality of openings is configured to enable flow of a refrigerant therethrough to bypass at least a portion of a compression chamber of the housing and flow toward the discharge side of the compressor.

3. The volume ratio control system of claim 2, wherein the piston is configured to translate within the chamber in a direction toward the end of the chamber to overlap with one or more openings of the plurality of openings and block flow of the refrigerant into the chamber via the one or more openings in response to the pressure differential meeting or exceeding a threshold pressure differential.

4. The volume ratio control system of claim 2, comprising a biasing device disposed within the cavity, wherein the biasing device is configured to exert a biasing force on the piston, and the biasing device is configured to translate the piston within the chamber in a direction away from the end of the chamber in response to the pressure differential falling below the biasing force.

5. The volume ratio control system of claim 1, comprising a discharge line extending through the housing to the chamber, wherein an exterior surface of the piston is fluidly exposed to the discharge line, and an interior surface of the piston, opposite the exterior surface, is fluidly exposed to the cavity.

6. The volume ratio control system of claim 5, wherein the discharge line is configured to be fluidly exposed to an oil pressure of the compressor.

7. The volume ratio control system of claim 1, comprising:

a rod extending into the chamber and extending into the cavity; and a biasing device disposed about the rod and within the cavity.

8. The volume ratio control system of claim 7, wherein the rod is fixed within the chamber via a threaded connection.

9. The volume ratio control system of claim 7, wherein the portion is a first portion, the chamber comprises a second portion fluidly coupled to the suction side of the compressor, and the rod extends through an opening formed in the housing between the first portion of the chamber and the second portion of the chamber.

10. The volume ratio control system of claim 9, wherein the rod comprises a passage fluidly coupling the second portion of the chamber and the cavity of the piston.

11. The volume ratio control system of claim 7, wherein a first end of the biasing device is fixed to the rod, and a second end of the biasing device, opposite the first end, is configured to exert a biasing force on an interior surface of the piston.

12. A compressor for a heating, ventilation, air conditioning, and/or refrigeration (HVAC&R) system, comprising:

a housing comprising a compression chamber;

a rotor disposed within the housing and configured to compress a refrigerant within the compression chamber; and a volume ratio control system configured to adjust a volume ratio of the compressor, wherein the volume ratio control system comprises:

a chamber formed within the housing, wherein the chamber comprises a first portion in fluid communication with a high pressure side of the compressor and a second portion in fluid communication with a low pressure side of the compressor; and a piston disposed within the chamber, wherein the piston comprises a cavity formed therein, an internal surface of the piston defining the cavity is in fluid communication with the low pressure side of the compressor, and an external surface of the piston is in fluid communication with the high pressure side of the compressor, wherein the housing comprises a plurality of openings formed therein, the plurality of openings fluidly couple the compression chamber and the chamber, the cavity is sealed from the plurality of openings, and the volume ratio control system is configured to passively adjust a position of the piston within the chamber to adjust the volume ratio of the compressor.

13. The compressor of claim 12, wherein the volume ratio control system is configured to passively adjust the position of the piston within the chamber in response to a change in a pressure differential between the high pressure side of the compressor and the low pressure side of the compressor.

14. The compressor of claim 13, wherein the piston is configured to translate within the chamber to adjust a first number of the plurality of openings blocked by the piston and to adjust a second number of the plurality of openings exposed by the piston.

15. The compressor of claim 13, wherein the volume ratio control system comprises a biasing device disposed within the cavity of the piston, wherein the biasing device is configured to adjust the position of the piston within the chamber in response to the pressure differential falling below a threshold value, wherein the threshold value is a variable threshold value.

16. The compressor of claim 12, wherein the volume ratio control system comprises a rod secured to the housing, the rod extends from the first portion of the chamber to the second portion of the chamber, the rod is disposed within the cavity, the volume ratio control system comprises a biasing device disposed about the rod, and the biasing device is fixed to the rod.

17. The compressor of claim 16, wherein the rod comprises a passage formed therein, and the passage fluidly couples the second portion of the chamber and the cavity.

18. The compressor of claim 12, wherein the external surface of the piston comprises a first external surface and a second external surface, the first external surface is disposed at a first end of the piston, the second external surface is disposed at a second end of the piston, opposite the first end, the second external surface faces an end of the first portion of the chamber, and the plurality of openings is formed in the housing at the end of the first portion of the chamber.

19. The compressor of claim 18, wherein the housing comprises a discharge line formed therein, and the discharge line is configured to fluidly couple the high pressure side of the compressor and the first portion of the chamber at the first end of the piston.

20. A volume ratio control system for a compressor, comprising:

a housing of the compressor, wherein the housing comprises a chamber formed therein, the chamber comprises a first portion in fluid communication with a discharge side of the compressor and a second portion in fluid communication with a suction side of the compressor, the housing comprises a plurality of openings formed therein, and the plurality of openings is configured to fluidly couple the first portion of the chamber to a compression chamber defined by the housing;

a piston disposed within the first portion of the chamber, wherein the piston comprises a cavity;

a rod coupled to the housing, wherein the rod extends into the second portion of the chamber and into the cavity, wherein the rod defines a passage fluidly coupling the second portion of the chamber and the cavity; and a biasing device disposed within the cavity and about the rod, wherein the biasing device is configured to passively adjust a position of the piston within the chamber based on a pressure differential between the suction side of the compressor and the discharge side of the compressor to block or expose at least a subset of the plurality of openings to adjust a volume ratio of the compressor.

* * * * *